United States Patent [19]

Leonard, Jr.

[11] 4,025,326

[45] May 24, 1977

[54] HEAT RECLAIMING SYSTEM

[75] Inventor: Louis H. Leonard, Jr., Dewitt, N.Y.

[73] Assignee: Carrier Corporation, Syracuse, N.Y.

[22] Filed: May 30, 1975

[21] Appl. No.: 582,560

[52] U.S. Cl. ..... 62/175; 62/333; 62/335

[51] Int. Cl.[2] ..... F25B 7/00; F25D 17/00

[58] Field of Search ..... 62/175, 238, 333, 335

[56] References Cited

UNITED STATES PATENTS

| | | | |
|---|---|---|---|
| 2,680,956 | 6/1954 | Haas | 62/175 |
| 3,064,446 | 11/1962 | Dodge | 62/335 |
| 3,188,829 | 6/1965 | Siewert et al. | 62/333 |
| 3,392,541 | 7/1968 | Nussbaum | 62/175 |
| 3,852,974 | 12/1974 | Brown | 62/175 |

*Primary Examiner*—Lloyd L. King
*Attorney, Agent, or Firm*—J. Raymond Curtin

[57] ABSTRACT

A refrigeration unit for providing both heating and cooling employing two, closed circuit, mechanical vapor compression systems operatively connected by an indirect heat exchanger positioned between the discharge of the compressor and the condenser of a first cooling system, the exchanger also serving as the evaporator in the second heating system.

3 Claims, 1 Drawing Figure

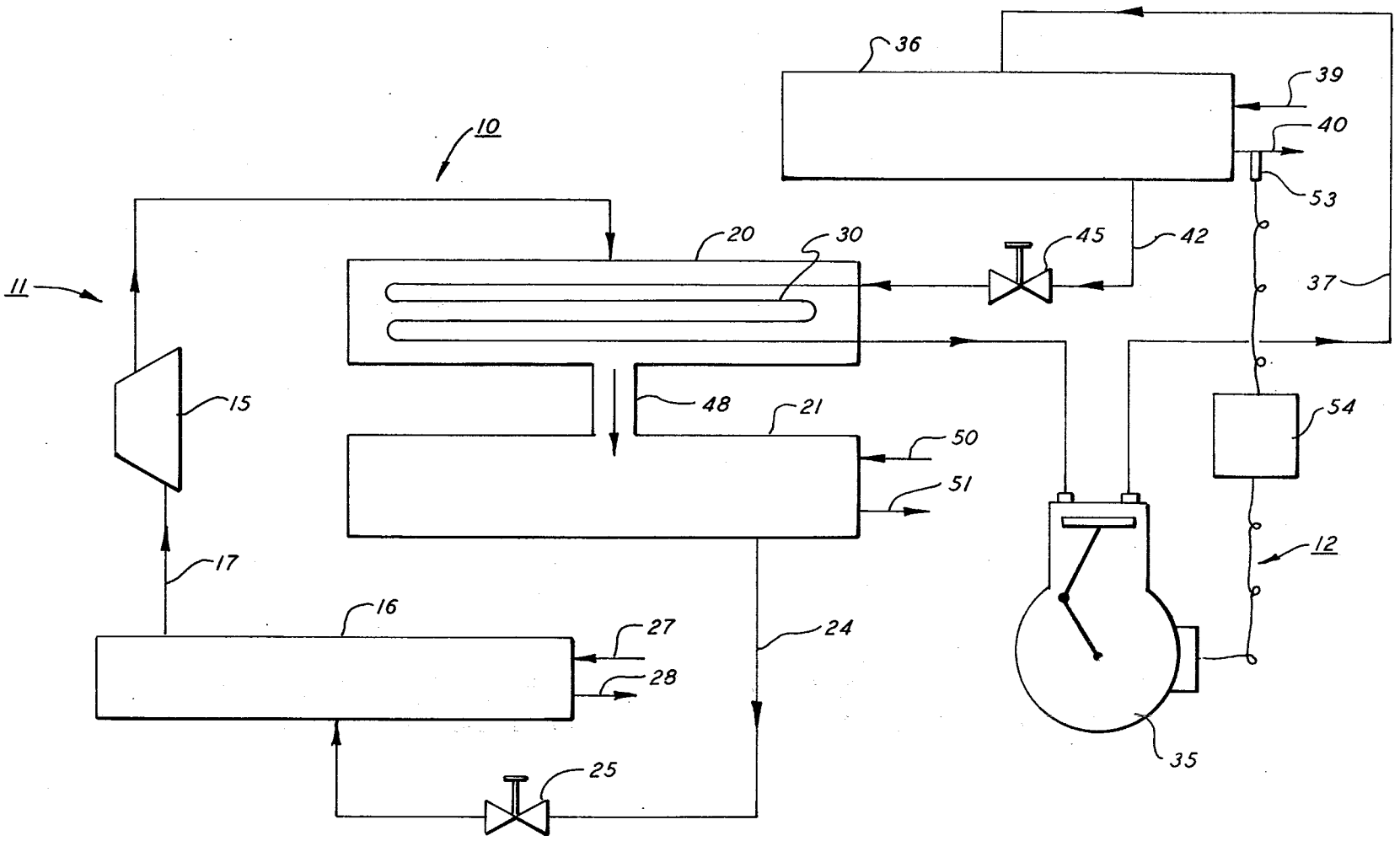
39
40
53
37
54
12
42
35
45
36
50
51
30
21
24
20
48
27
28
25
10
16
15
17
11

HEAT RECLAIMING SYSTEM

BACKGROUND OF THE INVENTION

This invention relates to a refrigeration unit having a high efficiency heat reclaiming cycle operatively associated therewith.

It has long been recognized that a mechanical vapor compression refrigeration system, relying on the reversed Carnot cycle, inherently rejects a relatively large amount of energy (heat) during the condensing phase of the cycle. Normally, this rejected energy is wasted. Efforts directed toward recovering this wasted energy in a usable form have heretofore proven to be generally unsatisfactory. For the most part, these efforts involve complex and costly equipment which cannot be readily implemented for use in existing refrigeration machines. Furthermore, in most prior art heating and cooling systems, the refrigeration condenser is required to meet the simultaneous demands imposed on the system by both the heating and cooling circuits. These demands are rarely mutually compatible and the efficient operation of one circuit typically must be sacrificed for the benefit of the other. That is to say, when both the heating and cooling circuits are required to share a common condenser, the condenser must be called upon to serve the peak demand imposed by one circuit while the other is forced to dependently follow. As a consequence, the overall operating efficiency of the system is adversely effected and, rather than conserving energy, which is the primary objective in heat reclaiming, the total system performance may, in fact, prove to be energy consuming.

SUMMARY OF THE INVENTION

It is therefore an object of the present invention to provide a refrigeration system which is capable of economically and efficiently recovering heat rejected therefrom.

A further object of the present invention is to improve the heat reclaiming characteristics of a mechanical vapor compression system.

Another object of the present invention is to provide a refrigeration system having a heat reclaiming circuit operatively associated therewith capable of meeting a wide range of heating demands without adversely effecting the cooling characteristics of the system.

A still further object of the present invention is to provide a heating and cooling refrigeration system whereby the heating and the cooling circuits can be controlled independently for simultaneous operation within the system.

Yet another object of the present invention is to provide a heatng circuit within a conventional refrigeration system which can be readily implemented within machines presently in the field.

These and other objects of the present invention are attained by means of a heating and cooling unit including a primary mechanical refrigeration system for providing cooling and a secondary mechanical refrigeration system for providing heating, the two systems being operatively related by means of an indirect heat exchanger arranged to bring refrigerants of the first system into heat transfer relationship with the refrigerants of the second system. In practice, the heat exchanger is operatively interposed between the discharge of the primary system compressor and primary system condenser whereby vapors discharged from the primary compressor are caused to move through the exchanger prior to entering the condenser. In the heat exchanger, high temperature vapors of the refrigerant contained in the first cooling system are brought into heat transfer relationship with the refrigerant contained in the secondary or heating system whereyb the first refrigerant condenses the cause the second refrigerant to evaporate. The evaporate is drawn from the exchanger by the compressor of the second system and delivered therefrom into a reclaiming condenser and the energy transferred to a heat recovery substance. At the same time, the heat exchanger works in conjunction with the condenser of the primary system to establish a condensing network capable of meeting the cooling demands imposed upon the primary system. By sharing the work of condensation between the two coacting units, the primary cooling system is effectively isolated from the secondary heating system whereby each system can be controlled independently.

BRIEF DESCRIPTION OF THE DRAWING

For a better understanding of the present invention, as well as other objects and further features thereof, reference is had to the following detailed description of the invention to be read in connection with the accompanying drawing wherein the drawing illustrates a schematic representation of apparatus employing the teachings of the present invention.

DESCRIPTION OF THE PREFERRED EMBODIMENT

Referring now to the drawing, there is shown a schematic illustration of a heating and cooling unit, generally referenced 10, embodying the teachings of the present invention. The unit contains two closed loop refrigeration circuits, a primary vapor compression circuit 11 for providing cooling in a conventional manner and a secondary heating vapor compression circuit 12, generally arranged to operated as a conventional heat pump.

The primary system includes a mechanical compressor 15 of any suitable type known in the art. Refrigerant vapors at a relatively low temperature and pressure are drawn from an evaporator cooler 16 via line 17 into the suction side of the compressor and work performed thereon to ideally raise the temperature and pressure of the refrigerant isentropically. Typically, superheated refrigerant vapors are discharged from the compressor and delivered into a condensing network made up of coacting heat exchanger 20 and primary condenser 21. As will be explained in greater detail below, the primary refrigerant is reduced to a condensate under the combined action of the two cooperating units and the condensate is then passed to the primary evaporator cooler 16 by supply line 24. An expansion valve 25 is positioned in the supply line for throttling the condensate from the high pressure side of the cooling system to the low pressure side thereof. In the evaporator cooler, the low temperature refrigerants are brought into heat transfer relationship with a medium to be cooled. For purposes of illustration, the medium is shown being brought into the cooler by inlet piping 27 and leaving by outlet piping 28. Although not shown, the cooling circuit described herein is controlled by any suitable regulating means known and used in the art.

Heat exchanger 20, which forms part of the condensing network on the primary or cooling side of the system, also serves as an evaporator in the secondary or heating circuit. In the embodiment herein described, the heat exchanger shown in an indirect type wherein the primary circuit refrigerant passes through the shell of the exchanger vessel. The refrigerant utilized in the secondary circuit is brought into heat transfer relation with the primary refrigerant by means of a tube bundle 30 contained within the vessel. It should be understood, however, that any type of indirect heat exchanger can be herein utilized, provided that the two refrigerants are physically separated during the heat transfer operation to preserve the closed-loop integrity of the primary and secondary circuits.

Preferably, the secondary heating circuit employs a reciprocating compressor, herein referenced 35. The suction side of the compressor is arranged to draw heated secondary refrigerants from the heat exchanger bundle. After the compresssor has performed work on the refrigerant, thus raising its temperature, the refrigerant is discharged into a heat recovery condenser 36 via line 37. Within the heat recovery condenser, the high temperature refrigerants are adiabatically condensed in heat transfer relationship with a reclaiming substance, such as water or the like, which is carried through the condenser by means of inlet and outlet lines 39, 40. After the secondary refrigerant has rejected heat into the reclaiming substance, it passes from the heating condenser back to the heat exchanger bundle by means of supply line 42. Here again, an expansion valve 45 is positioned in the supply line to throttle the refrigerant from the high pressure side of the secondary system to the low pressure side.

From the description above, it should be clear that the primary and secondary circuits represent independent closed loop systems which are interrelated solely by the energy crossing from one system boundary into the other. As a result, each circuit is isolated physically from the other and thus retain the ability to function independently.

As noted above, the heat exchanger 20 is arranged to receive high temperature refrigerant vapors discharged from the primary compressor. The primary vapors are caused to condense on the heat exchanger tubes with the heat of condensation being transferred to the lower temperature secondary circuit refrigerants throttled therein from the heat reclaiming condenser of the heating loop. Depending on the load demands imposed on both sides of the system, the vapor discharged from the primary compressor can be either partially or totally condensed within the heat exchanger. When only partial condensation takes place, a wet mixture of primary refrigerant is passed into the primary condenser from the heat exchanger via connecting piping 48 and the condensing process completed. The primary condenser can be operatively associated with a conventional cooling tower by means of water piping 50, 51 as shown in the drawing. The series coupled primary condenser and heat exchanger preferably each have a capacity to independently sustain the cooling circuit over its operating range so that all cooling demands are met regardless of the amount of energy rejected into the heating circuit. The cooling circuit in effect sees the condenser and heat exchanger combination as a single systems component and is therefore insensitive as to the manner in which these two units share the workload of condensation.

The secondary side of the system is also closed loop system and for its part is only concerned with the amount of heat transferred across the system boundaries within the heat exchanger. Control of the heating system is maintained in response to the temperature of the reclaiming substance leaving the heating condenser. A temperature sensor 53 is connected to the outlet line discharging the reclaiming substance from the condensor and adapted to send a signal to regulator 54 which controls the operation of the secondary compressor. By employing a reciprocating compresssor in this particular circuit, the capacity of the compressor can be conveniently controlled to meet heating demands over a wide operating range. For instance, when the temperature of the leaving reclaiming substance increases past a predetermined level, the sensor feeds information to the regulator which, in turn, unloads the compressor cylinder or cylinders, as the case may be. Accordingly, the capacity of the machine is reduced, thus lowering the amount of refrigerant discharge until such time as the reclaiming substance is brought back to the desired level. Similarly, when the temperature of the reclaiming substance decreases below the predetermined level, the unloaded compressor cylinders are brought back into operation, thus raising the capacity of the machine and the temperature of the reclaiming substance.

Although any type of mechanical compressor may be employed within the heating circuit, the reciprocating compressor is preferred because of its inherent ability to adjust to a wide range of pressure demands without appreciable loss in operating efficiency. Furthermore, the reciprocating compressor has the capability of delivering a high pressure ratio when compared to other types of compressors. In this regard, the compressor can be called upon to develop a temperature lift. That is, when the cooling circuit is operating under low load conditions and a relatively small amount of energy is being rejected into the heating system, the reciprocating compressor can be called on to perform mechanical work on the refrigerant to raise its temperature.

From the discussion above, it is apparent that only that amount of energy necessary to satisfy heating demands above the energy level rejected into the heating system within heat exchanger 30, is consumed by the secondary heating system. By the same token, the operation of the cooling system is in no way affected by these heating demands and both the cooling system and the heating system have the unique capability of operating independently to provide both heating and cooling over a wide range of operating conditions. Furthermore, the two systems rely solely on conventional refrigerants as working substances. As such, no water problems are encountered in the mutually shared heat exchanger and thus scaling and other water-associated problems are avoided within this critical section permitting the use of inexpensive aluminum or steel exchanger tubing. When a reciprocating compressor is used on the secondary heating side of the system, high suction temperatures can be efficiently realized which results in higher temperatures being achieved than are attainable in most prior art devices. Lastly, it should be noted that the present high lift heating circuit can be conveniently retrofitted to existing refrigeration equipment.

While this invention has been described with reference to the structure herein disclosed, it is not confined to the details as set forth, and this application is intended to cover any modifications or changes as may come within the scope of the following claims.

What is claimed is:

1. Apparatus for reclaiming energy from a refrigeration system including a first closed loop vapor compression refrigeration circuit having a mechanical compressor arranged to discharge vapors of a first refrigerant into a condenser, a heat exchanger interposed between the compressor and the first condenser of the first circuit being operatively arranged to bring vapors of the first refrigerant discharged from said compressor into contact with one side of a heat transfer surface prior to said refrigerant entering said condenser, a second closed loop vapor compression refrigeration circuit having a reciprocating compressor being capable of raising the temperature of a second refrigerant and being arranged to draw said second refrigerant from the opposite sideof the heat transfer surface contained within the heat exchanger and discharging vapors thereof into a heat reclaiming evaporator wherein the energy contained within said second refrigerant is recovered by a heat reclaiming substance, control means for sensing the temperature of the heat reclaiming substance leaving the heat reclaiming evaporator and regulating the output of the reciprocating compressor in response thereto.

2. The apparatus of claim 1 wherein said heating evaporator is positioned above said cooling condenser and the first refrigerant is gravity fed from the heating evaporator into the cooling condenser.

3. The apparatus of claim 2 wherein the capacity of either the heating evaporator and the cooling condenser is sufficient to supply the condensate needs of the cooling circuit.

* * * * *